US005141174A

United States Patent [19]

Sellers

[11] Patent Number: 5,141,174

[45] Date of Patent: Aug. 25, 1992

[54] APPARATUS AND METHOD FOR MEASURING MISSILE SEEKER ANGLE OF ATTACK

[75] Inventor: Robert J. Sellers, Weldon, Calif.

[73] Assignee: Commissioner of Patents & Trademarks, Washington, D.C.

[21] Appl. No.: 779,424

[22] Filed: Oct. 18, 1991

[51] Int. Cl.[5] ..... F41G 7/00

[52] U.S. Cl. ..... 244/3.21

[58] Field of Search ..... 244/3.15, 3.16, 3.19, 244/3.21

[56] References Cited

U.S. PATENT DOCUMENTS

| | | | |
|---|---|---|---|
| 4,500,051 | 2/1985 | Cottle, Jr. et al. | 244/3.16 |
| 4,549,707 | 10/1985 | Daukas | 244/3.21 |
| 4,624,424 | 11/1986 | Pinson | 244/3.21 |
| 4,637,571 | 1/1987 | Holder et al. | 244/3.16 |
| 4,646,990 | 3/1987 | Cleveland, Jr. | 244/3.21 |
| 4,676,456 | 6/1987 | Grosso et al. | 244/3.21 |
| 4,699,333 | 10/1987 | Pinson | 244/3.21 |
| 4,714,214 | 12/1987 | Schleimann-Jensen et al. | 244/3.16 |
| 4,790,493 | 12/1988 | Schwarzkopf et al. | 244/3.21 |
| 4,791,573 | 12/1988 | Zemany et al. | 244/3.21 |
| 4,830,311 | 5/1989 | Pritchard et al. | 244/3.15 |

*Primary Examiner*—Charles T. Jordan

*Attorney, Agent, or Firm*—Harvey A. Gilbert; Melvin J. Sliwka; John L. Forrest, Jr.

[57] ABSTRACT

A plurality of magnetic sensors mounted to a missile frame measure magnetic fields from magnets mounted to the movable portion of a seeker mounted in the missile frame. As the angle of attack changes, the field strength measured by each magnetic sensor changes. The magnetic sensors thus produce signals that may be calibrated and processed to determine the angle of attack.

5 Claims, 2 Drawing Sheets

APPARATUS AND METHOD FOR MEASURING MISSILE SEEKER ANGLE OF ATTACK

BACKGROUND OF THE INVENTION

1. Field of the Invention

This invention relates generally to apparatus and methods for measuring angular displacement. More particularly, this invention relates to measuring the angle of attack of a missile seeker without mechanically attaching external devices to the portion of the seeker head that is movable with respect to the missile frame.

2. Description of the Prior Art

The angle of attack of a missile is the angle between the longitudinal axis of the missile and the direction the missile is traveling. Ordinarily the angle of attack should be as small as possible to reduce wind drag, provide greater range and provide a greater impact velocity when the missile reaches its target. A seeker mounted in the missile has a portion that is rotatable in three dimensions relative to the frame. As the seeker moves toward the target, the angle of attack may be measured by measuring the angle between the movable section and the missile frame.

Previous attempts to measure the angle of attack of a seeker have included mounting rotational potentiometers on the axles of the movable section. Other attempts to make this measurement have included mounting linear potentiometers between the seeker and the frame of the missile. These techniques have failed because they induced errors in the operation of the seeker. Such devices have the undesirable effect of changing the natural frequency of oscillation of the seeker. The natural frequency should be known to verify flight characteristics.

U.S. Pat. No. 4,790,493 discloses a rate gyro in a seeker head of a missile. The rate gyro is stimulated to nutate with its natural nutation frequency in inertial space for scanning a field of view. The roll rate or roll angle may be determined by processing the difference of the rotational frequency and the nutation frequency of the rate gyro relative to the missile.

U.S. Pat. No. 4,830,311 discloses a guidance system in which a homing head or seeker is mounted on-board a missile. The guidance system allows establishment of inertial references via information derived from a seeker that need not be isolated from the missile body. The seeker has a range measuring function which may be used in combination with accelerometers to control the pitch, yaw and roll stabilization of the missile.

U.S. Pat. No. 4,791,573 discloses a system for determining deviations in the state of motion of a projectile from an intended state of motion. The system includes a comparison module that receives the outputs of a sensor array. The comparison module converts the sensor outputs into a measurement vector and computes the deviation of this measurement vector from an intended measurement vector received from a control system. The comparison module then determines the difference between this measured deviation and the deviation predicted by a Kalman filter.

U.S. Pat. No. 4,699,333 discloses an on-board flight control system for controlling pitch, yaw and roll. The system has a plurality of control panels operated by an actuator drive. The edge of the control panels is slanted so that when the panels are in an open position, clockwise and counterclockwise roll of the missile can be controlled.

U.S. Pat. No. 4,676,456 is directed to a roll reference for a strap down seeker in a spinning projectile. The reference is obtained by (a) determining the frequency spectrum of signals out of an accelerometer that is sensitive to roll precession and nutation forces, (b) separating the signals indicative of the roll forces, and (c) processing the separated roll force signals to determine the roll reference.

U.S. Pat. No. 4,646,990 is directed to a magnetic roll sensor calibrator. A coil mounted inside a spinning guided missile has an electrical current induced by interaction with the earth's magnetic field. A similar coil mounted on a launch platform spins at the same rate as the coil inside the spinning object. A phase signal is generated for the launch platform coil to provide a vertical reference that is used to correct guidance commands provided to the coil in the missile. A hold fire indicator is provided to inform the operator when the output from the launch platform's coil is above or below a predetermined level sufficient for adequate roll angle compensation.

U.S. Pat. No. 4,637,571 discloses an optical guidance system in which a body fixed electronic image stabilization of television imaging is used to allow strapdown seeker guidance in a missile. The body fixed electronic image stabilization compensates for routine vibrational and rotational motion experienced by a missile in flight. Compensation is accomplished by deliberately underscanning the camera and driving the camera's deflection coils with signals from pitch and yaw body rate sensors on the missile. The image developed on the camera detector raster is moved in an equal and opposite direction to the sensed motion as the motion occurs. Compensation thus stabilizes the resultant image, which should otherwise be a blur of motion on the display screen.

U.S. Pat. No. 4,624,424 discloses an on-board pitch, yaw and roll control actuator system for a missile. A plurality of control panels operated by an actuator drive are positioned in the airstream of the missile for controlling the direction, orientation and speed of the missile.

SUMMARY OF THE INVENTION

It is an object of the present invention to provide an apparatus and method for measuring angular position without introducing errors and without changing the characteristics of the system being measured. In particular it is an object of the invention to provide an improved apparatus and method for measuring the angle of attack of a missile or the like.

A system according to the present invention for producing signals that may be processed to determine angular displacement between a first body and a second body that is rotatable relative to the first body comprises a plurality of magnetic sensors affixed to the first body and a corresponding plurality of magnets mounted to the second body. Each of the magnetic sensors is configured to produce signals indicative of the magnitude of magnetic fields applied thereto. Each magnet produces a magnetic field that is detected by a corresponding one of the magnetic sensors. The plurality of magnets and the plurality of magnetic sensors are arranged such that rotation of the second body relative to the first body changes the magnitude of the magnetic field applied to each magnetic sensor.

A system according to the present invention for measuring the angle of attack may include four magnets affixed to the movable portion of a seeker and spaced about 90° apart around a circle. Four corresponding magnetic sensors are mounted to the missile frame to receive magnetic fields from the magnets to measure rotational movement between the first and second bodies in a plane.

DESCRIPTION OF THE PREFERRED EMBODIMENT

Figure 1:
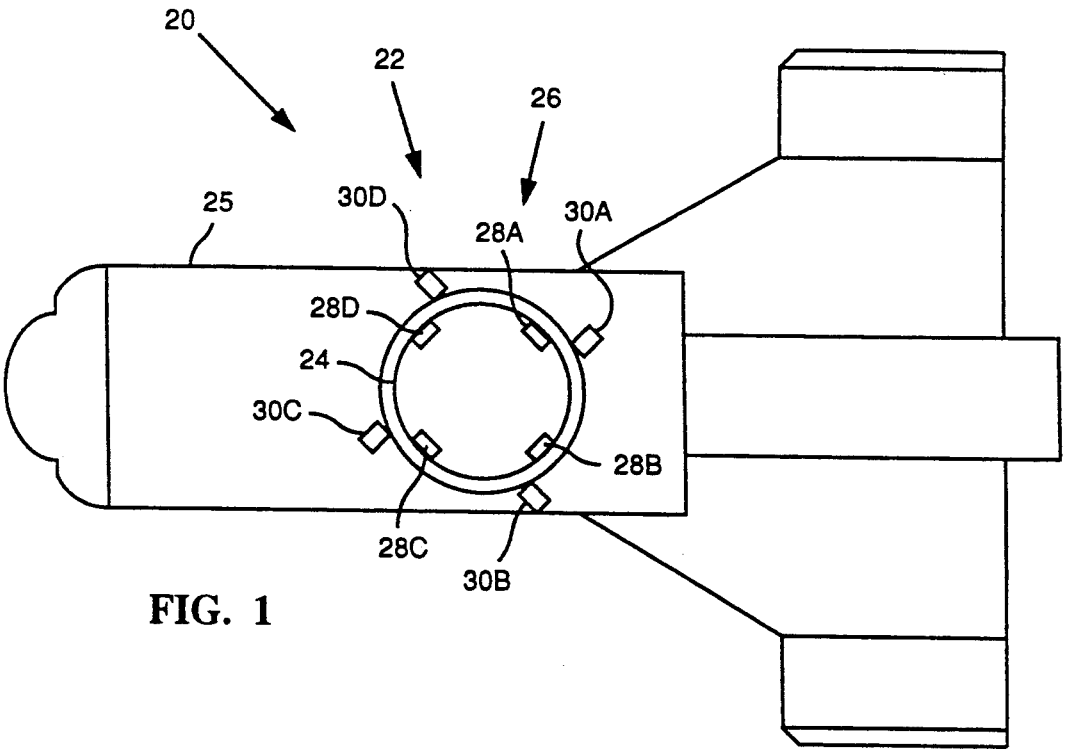
FIG. 1 illustrates a missile seeker that includes an angular sensor system according to the present invention.

Referring to FIG. 1, there is shown a missile 20 that includes a seeker 22. The seeker 22 includes a movable section 24 that is rotatable with very little friction relative to the missile frame 25. The seeker 22 may be visualized as a ball that is rotatable within a socket.

Still referring to FIG. 1, an angular measurement system 26 includes a plurality of magnets 28A, 28B, 28C and 28D mounted to the movable section 24. The magnets 28A, 28B, 28C and 28D preferably are located in small holes 90° apart around the circumference of the movable section 24.

The magnets 28A, 28B, 28C and 28D preferably have high flux densities. In a preferred embodiment of the invention, the magnets are formed of samarium cobalt which offers a high flux density and are about 3.57 mm square. Such magnets of the smallest size practical for the particular seeker application are selected so as to cause only a very minimal change in the weight and center of gravity of the movable section 24 of the seeker 22.

A plurality of magnetic sensors 30A, 30B, 30C and 30D are mounted in the fixed portion of the seeker 22 opposite the magnets 28A, 28B, 28C and 28D. In a preferred embodiment of the invention, the magnetic sensors are linear output Hall effect devices manufactured by Sprague Electric and sold as part number UGN 3503U. These sensors are small, inexpensive, immune to noise and are temperature stable.

Figure 2:
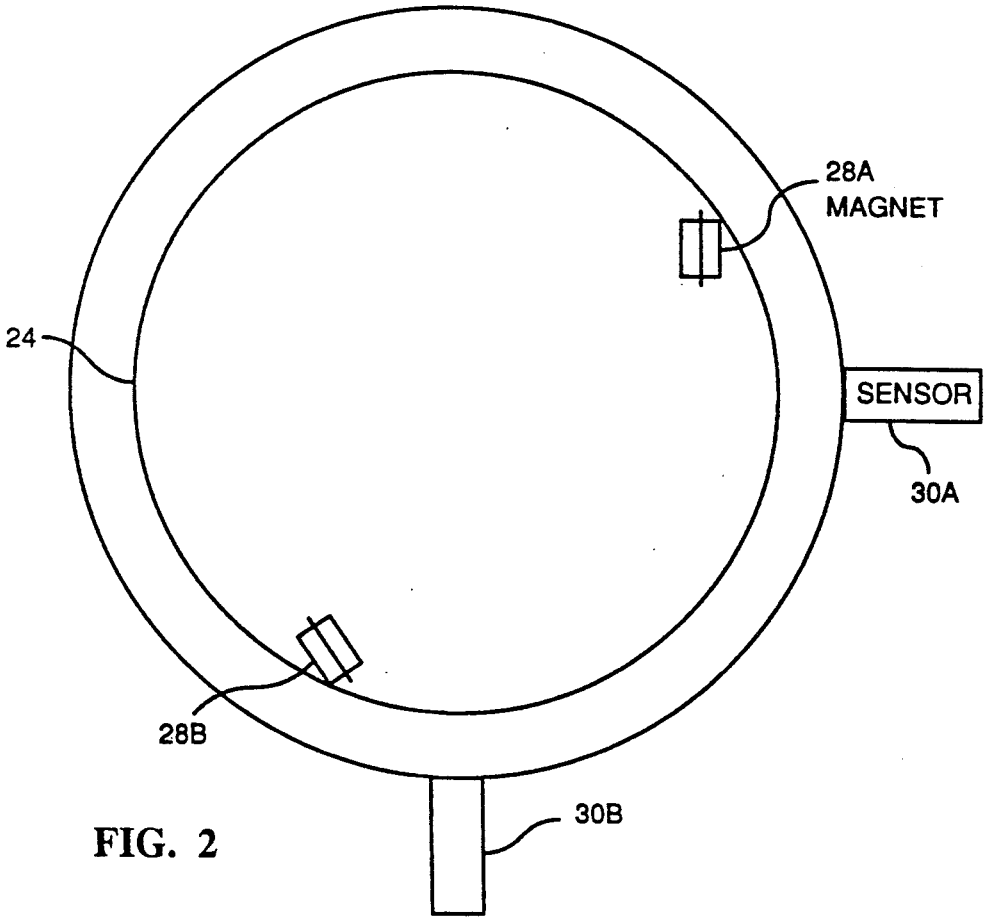
FIG. 2 illustrates relationships between a magnet and a magnetic sensor that may be included in the angular sensor system according to the present invention as the missile in which the angular sensor system is mounted moves in flight.

As the missile 20 and seeker 22 move in flight, the angle of attack may change, which changes the distance between each magnet and its corresponding sensor. For simplicity, only the changes in angle of attack caused by movement of the missile frame 25 in a vertical plane are shown in FIG. 2. It is to be understood that the missile frame may rotate in a horizontal plane and cause the relative positions of the magnets 28A, 28B, 28C and 28D to change relative to the magnetic sensors 40A, 40B, 40C and 40D.

Referring to FIG. 1, possible positions are illustrated for the magnets 28A and 28B relative to the magnetic sensors 30A and 30B, respectively. If the missile nose 27 (see FIG. 1) rotates downward or counterclockwise in the vertical plane from its direction of flight, the magnet 28A moves toward its corresponding magnetic sensor 30A. At the same time the magnet 28B moves toward its magnetic sensor 30B. The output voltage of the magnetic sensor 30A, therefore, increases and the output voltage of the magnetic sensor 30B increases for such rotations.

Similarly, if the missile frame pivots upward to cause a clockwise rotation of the magnets 28A and 28B as viewed in FIG. 2, then the magnet 28A moves away from its sensor 30A. As the magnet 28A gets closer to the magnetic sensor 30A, the magnetic field applied to the magnetic sensor 30A increases. In this situation, the magnet 28B also moves away from its sensor 30B. For upward pivoting of the nose of the missile 20, the output voltage of the magnetic sensor 30A therefore decreases and the output voltage of the magnetic sensor 30B decreases.

The magnets 28C and 28D also move relative to the magnetic sensors 30C and 30D in a manner similar to that described above for the magnets 28A and 28B. The magnets 28A, 28B, 28C and 28D may also be arranged relative to their corresponding magnetic sensors 30A, 30B, 30C and 30D, respectively such that for any deflection of the missile frame from its path of motion, two magnets will move closer to their corresponding magnetic sensors and two magnets will move away from their corresponding magnetic sensors. FIG. 2 shows two of the four corresponding sets of magnets and sensors, in this case magnet 28A and sensor 30B to produce this result where one pair of magnets diagonally opposite form each other are moving closer to each other and producing increasing output signals while the other pair of magnets are moving away from their respective sensors and producing a decreasing output signal.

As the missile frame 25 rotates, the sensor output signals change. The sensor output signals may be calibrated to yield the angle of the missile frame 25 relative to its direction of motion. The movable portion 24 of the seeker 22 is rotated through 360° and the outputs of the four sensors 30A, 30B, 30C and 30D are recorded as functions of the angular displacement of the movable portion.

Figure 3:
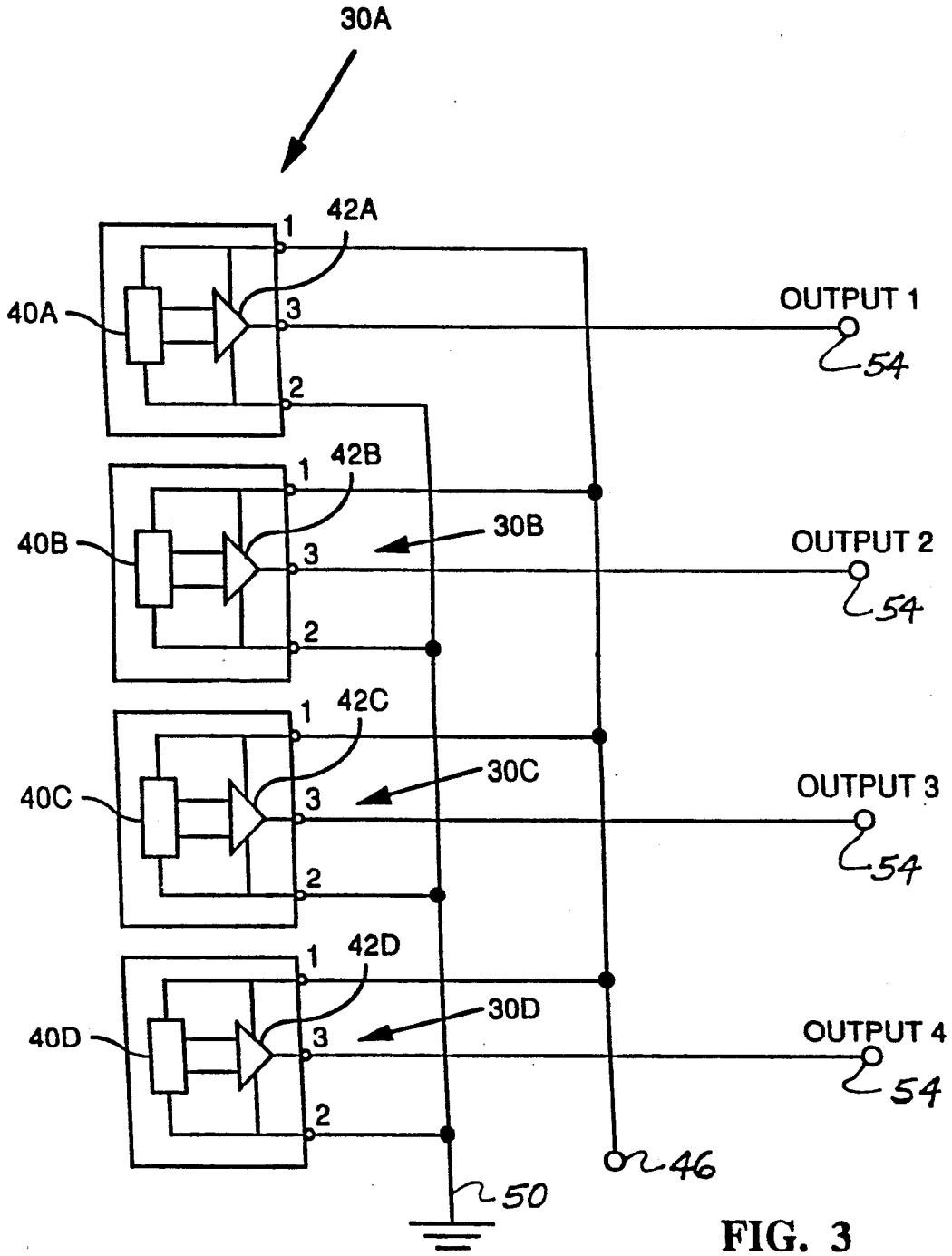
FIGS. 3 illustrates interconnection of a plurality of magnetic sensors to provide signals that may be processed to determine angular position.

Referring to FIG. 3, the magnetic sensor 30A includes a Hall effect sensor 40A. The Hall effect sensor 40A produces an electrical signal that is a function of the applied magnetic field from the corresponding magnet 28A. An amplifier 42A amplifiers the signal output from the Hall effect sensor 40 to produce electrical output levels sufficient for directly driving the telemetry commutator with a signal identified as output 1 in FIG. 3. The magnetic sensors 30B, 30C and 30D include Hall effect sensors 40B, 40C, 40D and amplifiers 42B, 42C and 42D that are essentially identical to the Hall effect sensor 40A and the amplifier 42A, respectively.

The magnetic sensor 30A has a first terminal 46 that is connected to an electrical power source (not shown). A second terminal 50 of the magnetic sensor 30A is grounded. The signal output 1 emanates from a third terminal 54. The other magnetic sensors 30B, 30C, 30D preferably have terminals that are identical to those of the magnetic sensor 30A. The first terminals of the other magnetic sensors 30B, 30C, 30D are also connected to the electrical power source. The second terminals 50 of the magnetic sensors 30B, 30C, 30D are grounded and the third terminals 54 provide signal outputs 2, 3 and 4, respectively.

The circuit of FIG. 3 is capable of providing input directly into a telemetry system (not shown) and providing usable data. The amplifiers 42A, 42B, 42C and 42D preferably each include a differential amplifier between opposite outputs with a gain stage following to provide greater dynamic range and better accuracy. The outputs of the magnetic sensors 30A, 30B, 30C, 30D may be converted into digital form and then input to a computer (not shown), which gives the angle in degrees.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A system for producing signals to be processed to determine angular displacement between a first body and a second body that is rotatable relative to the first body, comprising:

a plurality of magnetic sensors affixed to the first body, each of the magnetic sensors being configured to produce signals indicative of the magnitude of magnetic fields applied thereto; and a plurality of magnets affixed to the second body such that each magnet produces a magnetic field that is detected by a corresponding one of the magnetic sensors, the plurality of magnets and the plurality of magnetic sensors being arranged such that rotation of the second body relative to the first body changes the magnitude of the magnetic field applied to each magnetic sensor.

2. The system of claim 1 including four magnets affixed to the second body and spaced about 90° apart around a circle and four corresponding magnetic sensors mounted to the first body to receive magnetic fields from the magnets to measure rotational movement between the first and second bodies in a plane.

3. A method for producing signals to be processed to determine angular displacement between a first body and a second body that is rotatable relative to the first body, comprising the steps of:

affixing a plurality of magnetic sensors to the first body, each of the magnetic sensors being configured to produce signals indicative of the magnitude of magnetic fields applied thereto;

affixing a plurality of magnets to the second body such that each magnet produces a magnetic field that is detected by a corresponding one of the magnetic sensors; and arranging the plurality of magnets and the plurality of magnetic sensors such that rotation of the second body relative to the first body changes the magnitude of the magnetic field applied to each magnetic sensor.

4. The method of claim 3 including the steps of:

mounting four magnets to the second body and spaced about 90° apart around a circle; and mounting four corresponding magnetic sensors to the first body to receive magnetic fields from the magnets to measure rotational movement between the first and second bodies in a plane.

5. The method of claim 3 including the steps of:

rotating the second body relative to the first body through predetermined angles; and measuring the signals output from the magnetic sensors to relate signals to the predetermined angles.

* * * * *